US008794754B2

(12) United States Patent
Shimizu

(10) Patent No.: US 8,794,754 B2
(45) Date of Patent: Aug. 5, 2014

(54) RECORDING APPARATUS

(75) Inventor: Seiji Shimizu, Ogaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 132 days.

(21) Appl. No.: 13/332,167

(22) Filed: Dec. 20, 2011

(65) Prior Publication Data

US 2012/0162336 A1 Jun. 28, 2012

(30) Foreign Application Priority Data

Dec. 21, 2010 (JP) ..... 2010-284703
Dec. 21, 2010 (JP) ..... 2010-284704

(51) Int. Cl.
*B41J 2/01* (2006.01)

(52) U.S. Cl.
USPC ..... 347/102

(58) Field of Classification Search
USPC ..... 347/16, 21, 95, 96, 100–102
IPC ..... B41J 2/01
See application file for complete search history.

(56) References Cited

U.S. PATENT DOCUMENTS

| | | | | |
|---|---|---|---|---|
| 2005/0190248 | A1 | 9/2005 | Konno et al. | |
| 2006/0158494 | A1 | 7/2006 | Yamanobe | |
| 2007/0024686 | A1 | 2/2007 | Kadomatsu et al. | |
| 2007/0046720 | A1* | 3/2007 | Konno et al. | 347/21 |
| 2009/0085996 | A1* | 4/2009 | Kasai | 347/100 |
| 2009/0225143 | A1* | 9/2009 | Fukui | 347/102 |
| 2009/0233061 | A1* | 9/2009 | Irita | 428/195.1 |

FOREIGN PATENT DOCUMENTS

| | | | |
|---|---|---|---|
| JP | 2005-280346 | A | 10/2005 |
| JP | 2006-218860 | A | 8/2006 |
| JP | 2007-001023 | A | 1/2007 |
| JP | 2007-030464 | A | 2/2007 |
| JP | 2009-083315 | A | 4/2009 |
| JP | 2010-082939 | A | 4/2010 |

OTHER PUBLICATIONS

Japan Patent Office, Notice of Reasons for Rejection for Japanese Patent Application No. 2010-284703 (counterpart Japanese patent application), mailed Dec. 17, 2013.

* cited by examiner

*Primary Examiner* — Manish S Shah
*Assistant Examiner* — Roger W Pisha, II
(74) *Attorney, Agent, or Firm* — Baker Botts L.L.P.

(57) ABSTRACT

A recording apparatus including a conveyor which conveys a recording medium in a conveyance direction; a recording head which ejects recording liquid curable by irradiation of ultraviolet light; a plurality of pretreatment heads which ejects pretreatment liquid curable by irradiation of ultraviolet light, the pretreatment heads including a downstream pretreatment head and an upstream pretreatment head which is positioned upstream of the downstream pretreatment head in the conveyance direction; and a controller which controls the conveyor and the pretreatment heads to cause: a total amount of liquid droplets ejected from the downstream pretreatment head to be greater than a total amount of liquid droplets ejected from the upstream pretreatment head; and a liquid droplet ejected from the downstream pretreatment head to overlap, on the recording medium, a liquid droplet which has been ejected from the upstream pretreatment head.

9 Claims, 8 Drawing Sheets

RECORDING APPARATUS

CROSS REFERENCE TO RELATED APPLICATION

This application claims priority from Japanese Patent Applications No. 2010-284703 and No. 2010-284704, which were filed on Dec. 21, 2010, the disclosure of which is herein incorporated by reference in its entirety.

BACKGROUND OF THE INVENTION

1. Field of the Invention

The present invention relates to a recording apparatus which conducts recording using a liquid curable by irradiation of ultraviolet light.

2. Description of Related Art

There has been known a recording apparatus which conducts recording using a liquid curable by irradiation of ultraviolet light, such as ultraviolet (UV) curable ink. The recording apparatus may include: for example, a recording head which ejects, to a recording medium, recording liquid curable by irradiation of ultraviolet light; and a UV irradiator such as a light source which applies ultraviolet light to the recording medium. The UV irradiator is positioned downstream of the recording head in a conveyance direction of the recording medium. The UV irradiator may be positioned immediately downstream of the recording head in the conveyance direction in order to prevent bleed of the recording liquid on the recording medium. Here, the bleed means excessive spreading.

SUMMARY OF THE INVENTION

However, even if the UV irradiator is positioned immediately downstream of the recording head in the conveyance direction, there is a case where the bleed is not sufficiently prevented on some types of recording media. For example, the bleed hardly occurs on a recording medium of a resin film or a recording medium which has been subjected to processing for preventing infiltration of the recording liquid, however, in the case where a recording medium is plain paper which has not been subjected to such processing, the recording liquid is more likely to infiltrate into the recording medium, and it is not possible to sufficiently prevent the bleed.

One of the ways to deal with this is to eject pretreatment liquid having a function of preventing the bleed of the recording liquid on a recording medium in advance on an area of the recording medium where the recording liquid is to be landed, thereby to form a layer constituted of the pretreatment liquid in a surface of the recording medium. In this case, the recording liquid is placed on and overlaps the layer constituted of the pretreatment liquid, and is retained on the surface, and thereby an image having desired quality is obtained.

However, there is a possibility that the pretreatment liquid infiltrates into a recording medium, which causes bleed-through of the pretreatment liquid. Here, the bleed-through means a phenomenon in which liquid landed on one face of a recording medium bleeds through the recording medium and seeps to the other face of the recording medium. In this case, an amount of pretreatment liquid retained in the surface of the recording medium is small relative to an ejection amount of the pretreatment liquid. As a result, it is not possible to sufficiently obtain an advantageous effect of bleed prevention brought about by the pretreatment liquid.

On the other hand, if the ejection amount of pretreatment liquid is decreased in order to prevent the bleed-through of the pretreatment liquid, the amount of pretreatment liquid is insufficient for preventing the bleed of the recording liquid. Thus, also in this case, it is not possible to sufficiently obtain the advantageous effect of bleed prevention brought about by the pretreatment liquid.

An object of the present invention is to provide a recording apparatus which makes it possible to sufficiently obtain the advantageous effect of bleed prevention brought about by the pretreatment liquid.

According to a first aspect of the present invention, provided is a recording apparatus, comprising: a conveyor which conveys a recording medium in a conveyance direction; a recording head which ejects, to the recording medium, recording liquid curable by irradiation of ultraviolet light; a plurality of pretreatment heads each of which is positioned upstream of the recording head in the conveyance direction, and ejects, to the recording medium, pretreatment liquid curable by irradiation of ultraviolet light, the pretreatment heads including a downstream pretreatment head and an upstream pretreatment head which is positioned upstream of the downstream pretreatment head in the conveyance direction; a first UV irradiator which is positioned downstream of the recording head in the conveyance direction and applies ultraviolet light to the recording medium; and a controller which controls the conveyor, the recording head, the pretreatment heads, and the first UV irradiator. The controller controls the conveyor and the pretreatment heads to cause: a total amount of liquid droplets ejected from the downstream pretreatment head to be greater than a total amount of liquid droplets ejected from the upstream pretreatment head; and a liquid droplet ejected from the downstream pretreatment head to overlap, on the recording medium, a liquid droplet which has been ejected from the upstream pretreatment head.

According to a second aspect of the present invention, provided is a recording apparatus, comprising: a conveyor which conveys a recording medium in a conveyance direction; a recording head which ejects, to the recording medium, recording liquid curable by irradiation of ultraviolet light; a plurality of pretreatment heads each of which is positioned upstream of the recording head in the conveyance direction, and ejects, to the recording medium, pretreatment liquid curable by irradiation of ultraviolet light, the pretreatment heads including a downstream pretreatment head and an upstream pretreatment head which is positioned upstream of the downstream pretreatment head in the conveyance direction; a first UV irradiator which is positioned downstream of the recording head in the conveyance direction and applies ultraviolet light to the recording medium; a second UV irradiator which is positioned between the upstream pretreatment head and the downstream pretreatment head in the conveyance direction, and applies ultraviolet light to the recording medium; a third UV irradiator which is positioned between the downstream pretreatment head and the recording head in the conveyance direction, and applies ultraviolet light to the recording medium; and a controller which controls the conveyor, the recording head, the pretreatment heads, the first UV irradiator, the second UV irradiator, and the third UV irradiator, wherein the controller controls the second UV irradiator and the third UV irradiator to cause an intensity of ultraviolet light applied by the second UV irradiator to be greater than an intensity of ultraviolet light applied by the third UV irradiator.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred embodiment of the present invention, with reference to the drawings.

Figure 1:
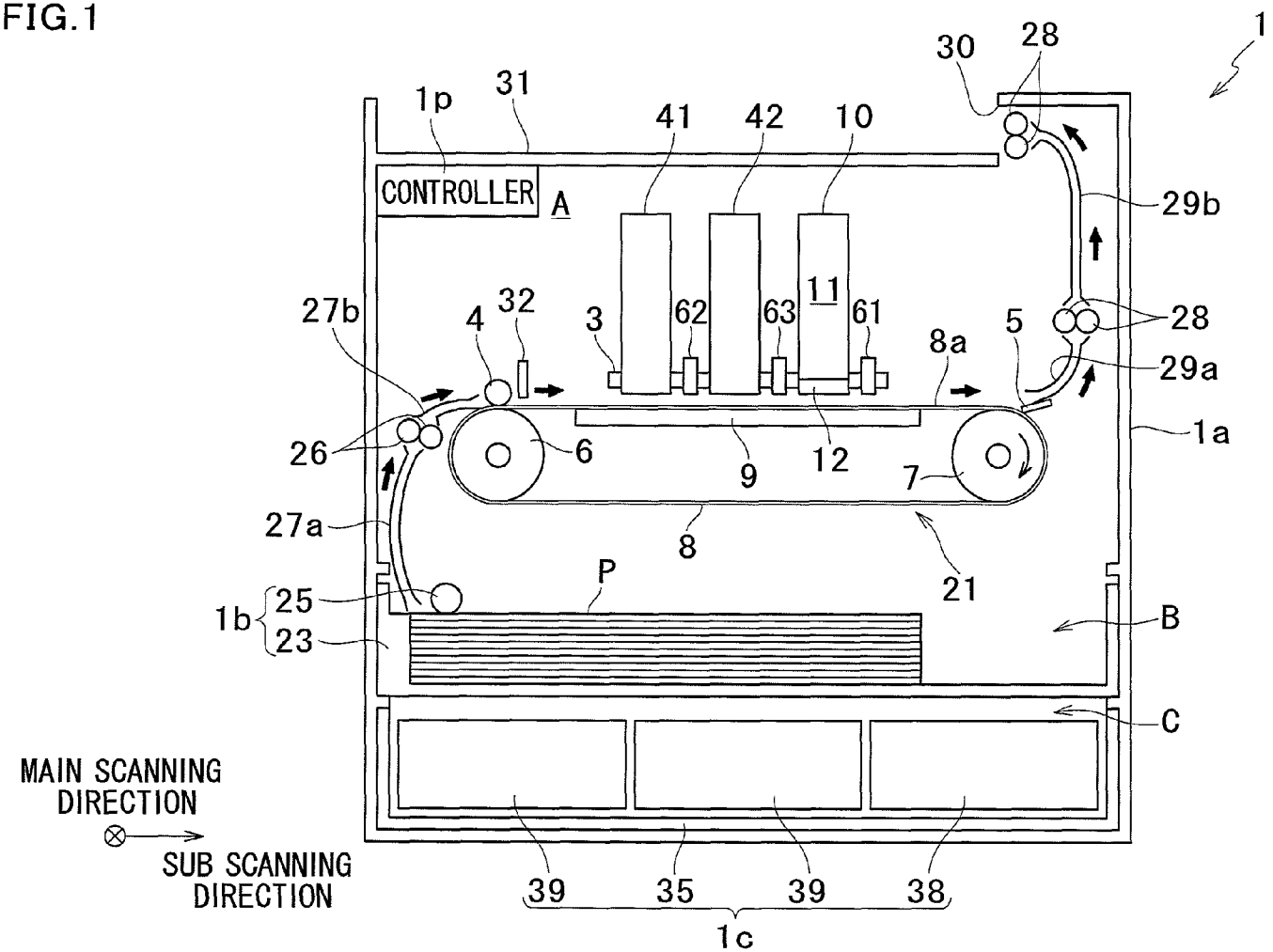
FIG. 1 is a schematic side view illustrating an internal structure of an ink-jet printer which is one embodiment of the present invention.

First, with reference to FIG. 1, an overall structure of an ink-jet printer 1 which is an embodiment of the present invention will be described.

The printer 1 has a housing 1*a* of a rectangular parallelepiped shape. A discharged paper receiver 31 is provided on a top panel of the housing 1*a*. An internal space of the housing 1*a* is capable of being divided into spaces A, B, and C, from the top to the bottom. In the space B, a paper feed unit 1*b* is disposed. A sheet conveyance path from the paper feed unit 1*b* to the discharged paper receiver 31 is formed in the spaces A and B.

In the space A, there are disposed: two precoating heads 41 and 42; one ink-jet head 10; three UV irradiators 61, 62, and 63; a conveyor unit 21; a guide unit; a controller 1*p*; and the like.

The conveyor unit 21 has: belt rollers 6 and 7; an endless conveyor belt 8 looped around the rollers 6 and 7; a nip roller 4 and a peel plate 5 which are disposed outside a loop of the conveyor belt 8; a platen 9 disposed inside the loop of the conveyor belt 8; and the like. The belt roller 7 is a driving roller, which is driven by a conveyor motor 121 (see FIG. 6), and rotates in a clockwise direction in FIG. 1. As the belt roller 7 rotates, the conveyor belt 8 travels in a direction of bold arrows in FIG. 1. The belt roller 6 is a driven roller, and rotates in the clockwise direction in FIG. 1 as the conveyor belt 8 travels. The nip roller 4 is disposed so as to face the belt roller 6, and presses a sheet P fed by an upstream guide unit onto an external surface 8*a* of the conveyor belt 8. The peel plate 5 is disposed so as to face the belt roller 7, and peels a sheet P from the external surface 8*a* to guide the sheet P to a downstream guide unit. The platen 9 is disposed so as to face the three heads 10, 41, and 42, and supports an upper loop of the conveyor belt 8 from an inside of the loop. This creates a predetermined gap suitable for recording between the external surface 8*a* and under surfaces of the heads 10, 41, and 42.

Each of the heads 10, 41, and 42 is a line-type head which extends in a main scanning direction and has a substantially rectangular parallelepiped shape. The under surface of each of the heads 10, 41, and 42 is an ejection surface having a plurality of ejection openings (see ejection openings 14*a* of the head 10, shown in FIGS. 3 and 4). At the time of recording, black UV curable ink which is curable by irradiation of ultraviolet light is ejected from the under surface, i.e., an ejection surface 10*a*, of the head 10. Depending on circumstances, pretreatment liquid curable by irradiation of ultraviolet light is ejected from the under surfaces of the heads 41 and 42 to a sheet P on which the ink has not been landed yet.

The pretreatment liquid is a liquid having a function of preventing bleed of ink on a sheet P. The pretreatment liquid may further include another function other than that described above, for example, a function of improving thickness, color reproduction, quick drying property, or the like of ink landed on a sheet P, a function of decreasing occurrence of creases on or curling of a sheet P on which ink has been landed, and the like. Materials for the pretreatment liquid are selected according to the situation, and for example, it is possible to use a liquid containing cationic polymer or a liquid containing polyvalent metal salts such as magnesium salts. It is preferable that the pretreatment liquid is colorless, in terms of recording quality.

The UV irradiators 61, 62, and 63 are provided for the heads 10, 41, and 42, respectively, and are disposed downstream of the respective heads 10, 41, and 42 in a direction along which a sheet P is conveyed by the conveyor unit 21. This direction is indicated with bold arrows in FIG. 1, and is hereinafter simply referred to as a "conveyance direction". The UV irradiators 61, 62, and 63 have a same structure as one another, and each of the UV irradiators extends in the main scanning direction and has an outline of substantially rectangular parallelepiped shape, in the same way as the head 10. A plurality of light sources such as halogen lamps, mercury lamps, metal halide lamps, LED elements, LD elements, or the like arranged in the main scanning direction are provided on an under surface of each of the UV irradiators 61, 62, and 63. At the time of recording, ultraviolet light is applied by the UV irradiators 61, 62, and 63, to cure and fix liquid, i.e., the ink and the pretreatment liquid, attached onto a sheet P. Hereinafter the ink and the pretreatment liquid are collectively referred to as "the liquid".

The heads 10, 41, and 42, and the UV irradiators 61, 62, and 63 are arranged at predetermined intervals in a sub scanning direction in the following order: the precoating head 41; the UV irradiator 62; the precoating head 42; the UV irradiator 63; the ink-jet head 10; and the UV irradiator 61, from an upstream side to a downstream side in the conveyance direction, and they are supported by the housing 1*a* via a frame 3.

The guide unit includes the upstream guide unit and the downstream guide unit which are disposed with the conveyor unit 21 interposed therebetween. The upstream guide unit has: two guides 27*a* and 27*b*; and a pair of feed rollers 26. The upstream guide unit connects the paper feed unit 1*b* to the conveyor unit 21. The downstream guide unit has: two guides 29*a* and 29*b*; and two pairs of feed rollers 28. The downstream guide unit connects the conveyor unit 21 to the discharged paper receiver 31.

The paper feed unit 1*b* has a paper feed tray 23 and a paper feed roller 25. Of these, the paper feed tray 23 is removable from the housing 1*a*. The paper feed tray 23 is a box having an open top, and is capable of containing different sizes of sheets P. The paper feed roller 25 forwards an uppermost sheet P of the sheets P contained in the paper feed tray 23 and feeds the sheet P to the upstream guide unit.

The controller 1*p* controls operation of each unit of the printer 1, thereby controlling overall operation of the printer 1. Based on image data supplied from an external device such as a PC connected to the printer 1, the controller 1*p* controls the following operations of: preparation related to recording; feed, conveyance, and discharge of a sheet P; ejection of the liquid and irradiation of ultraviolet light in synchronization with the conveyance of the sheet P; and the like, in order that an image is formed on the sheet P.

Based on a recording command received from the external device, the controller 1*p* drives: a paper feed motor 125 (see FIG. 6) for the paper feed roller 25; a feed motor 127 (see FIG. 6) for the feed rollers of each of the upstream and downstream guide units; the conveyor motor 121 (see FIG. 6); the heads 10, 41, and 42; the UV irradiators 61, 62, and 63; and the like. A sheet P forwarded from the paper feed tray 23 is fed to the conveyor unit 21 by the feed rollers 26. When the sheet P passes immediately below the respective heads 10, 41, and 42 in the sub scanning direction, ink is ejected from the head 10 and, depending on circumstances, the pretreatment liquid is ejected from the heads 41 and 42, and furthermore, ultraviolet light is applied by the UV irradiators 61, 62, and 63 to cure the liquid, with the result that an image is formed on the sheet P. The ejection of the liquid and irradiation of ultraviolet light are conducted based on a detection signal from a sheet sensor 32 which detects a leading end of the sheet P. Then, the sheet P is peeled by the peel plate 5, and conveyed upward by the two pairs of feed rollers 28. Then, the sheet P is discharged from an opening 30 located above, to the discharged paper receiver 31.

Here, the sub scanning direction is a direction parallel to the conveyance direction, and the main scanning direction is a direction parallel to a horizontal surface and perpendicular to the sub scanning direction.

In the space C, a cartridge unit 1*c* is disposed removably from the housing 1*a*. The cartridge unit 1*c* has: a tray 35; and three cartridges 38 and 39 placed side-by-side with one another in the tray 35. The cartridge 38 reserves the black UV curable ink, while each of the cartridges 39 reserves the pretreatment liquid, and these cartridges respectively communicate with the corresponding heads 10, 41, and 42, via tubes (not shown). The liquid in the cartridges 38 and 39 is supplied to the corresponding heads 10, 41, and 42, where necessary. Note that the two cartridges 39 may have the pretreatment liquid of a same composition as each other. That is, the pretreatment liquid ejected from the head 41 and the pretreatment liquid ejected from the head 42 may have the same composition as each other.

Next, the structure of each of the heads 10, 41, and 42 will be described in more detail. The heads 10, 41, and 42 have a same structure as one another, except that their resolutions are different from one another. The head 10 has a resolution of 600 dpi (dots per inch), the head 41 has a resolution of 1200 dpi, and the head 42 has a resolution of 300 dpi. The following describes the structure of the head 10 with reference to FIGS. 2 to 5. Note that in FIG. 3, pressure chambers 16 and apertures 15, which are located below actuator units 17 and should be illustrated with dotted lines, are illustrated with solid lines.

Figure 5:
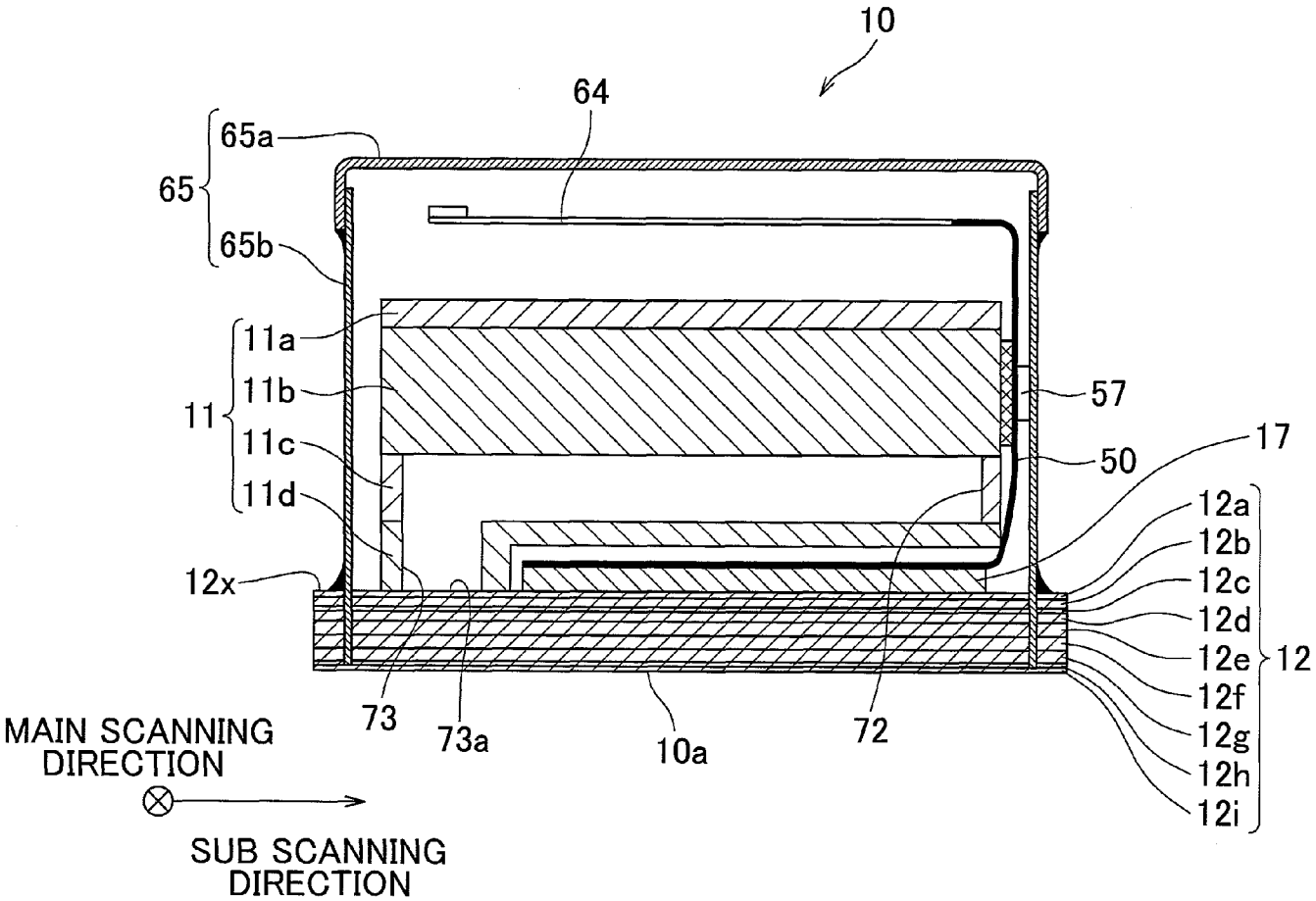
FIG. 5 is a vertical sectional view of the ink-jet head.

As shown in FIG. 5, the head 10 is a member constructed by stacking a passage unit 12, the actuator units 17, a reservoir unit 11, and a substrate 64. Of these, the actuator units 17, the reservoir unit 11, and the substrate 64 are housed in a space created by an upper surface 12*x* of the passage unit 12 and a cover 65. In this space, FPCs (flexible printed circuit) 50 electrically connect the respective actuator units 17 to the substrate 64. Each FPC 50 has a driver IC 57 mounted on a portion between both ends of the FPC 50.

As shown in FIG. 5, the cover 65 includes a top cover 65*a* and a side cover 65*b*. The cover 65 is a box having an open bottom, and fixed to the upper surface 12*x* of the passage unit 12. The side cover 65*b* is made of aluminum plates, and also functions as a heatsink. The driver IC 57 abuts an internal surface of the side cover 65*b*, and is thermally coupled with the cover 65*b*.

The reservoir unit 11 is a stack constituted of four metal plates 11*a* to 11*d* attached to one another, in each of which plates a through hole and/or a recess is/are formed. Protrusions are formed on a surface of the plate 11*d*. A passage including a reservoir 72 is formed inside the reservoir unit 11. One end of the passage is connected, via the tube or the like, to the cartridge 38 (for the heads 41 and 42, to the respective cartridges 39), while the other end of the passage is connected to openings provided at an under surface of the reservoir unit 11. In the plate 11*d*, there are formed outflow passages 73 communicating with the reservoir 72. One end of each of the outflow passages 73 is connected to an opening provided at an end surface of the corresponding protrusion of the plate 11*d*, which surface is bonded to the upper surface 12*x*.

Figure 2:
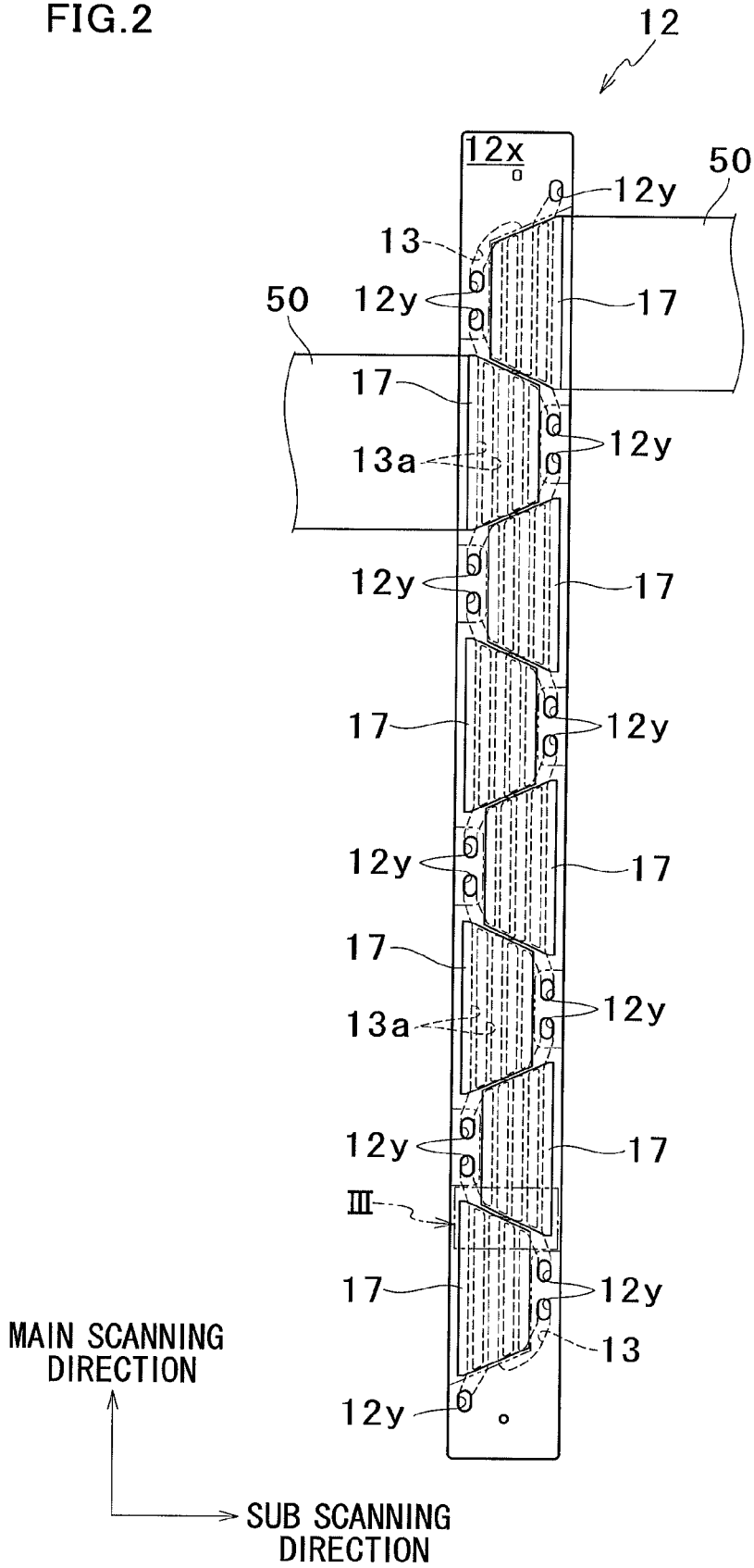
FIG. 2 is a plan view illustrating a passage unit and actuator units of an ink-jet head included in the printer of FIG. 1.
Figure 3:
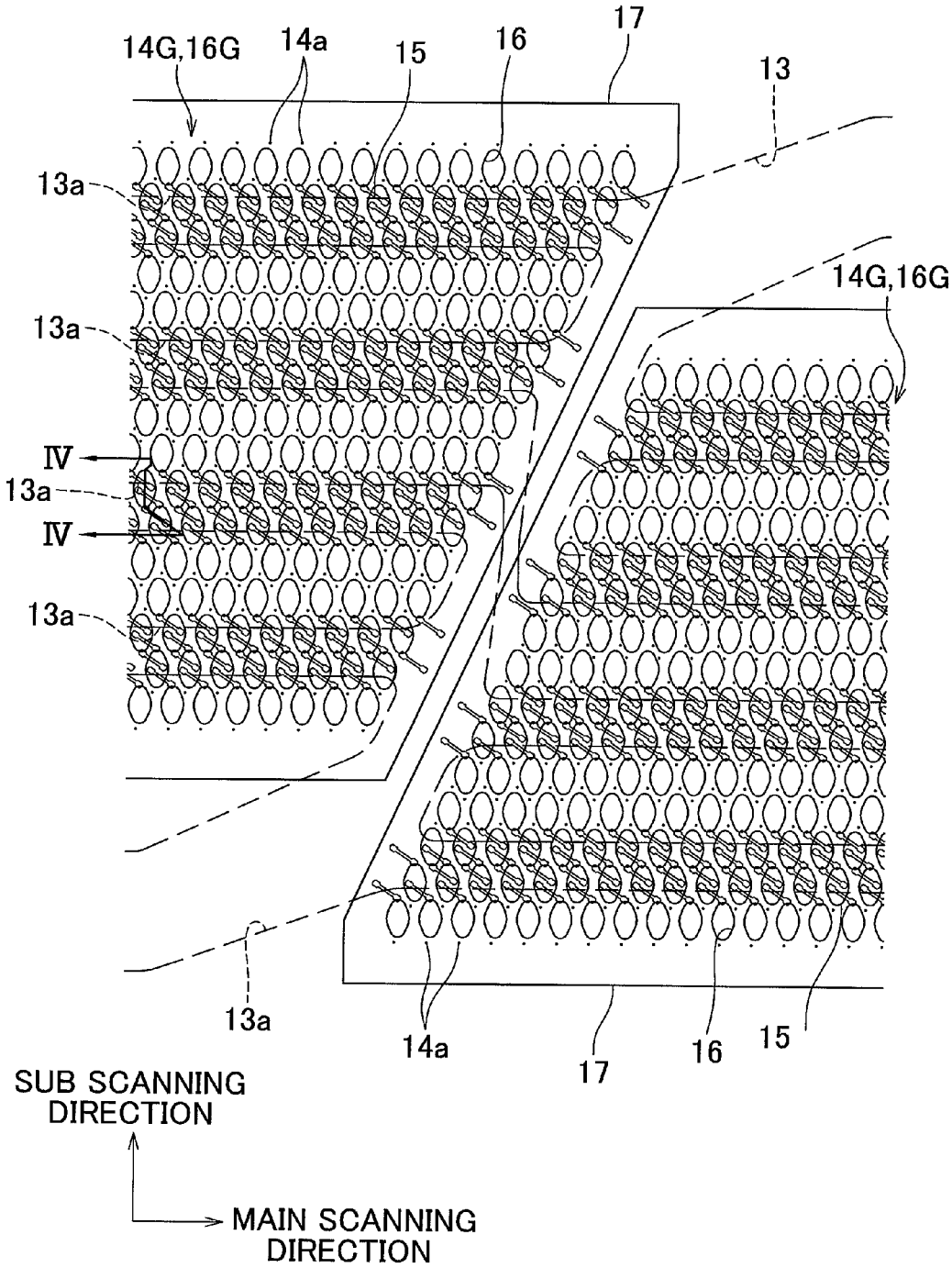
FIG. 3 is an enlarged view illustrating an area III encircled by an alternate long and short dash line of FIG. 2.
Figure 4:
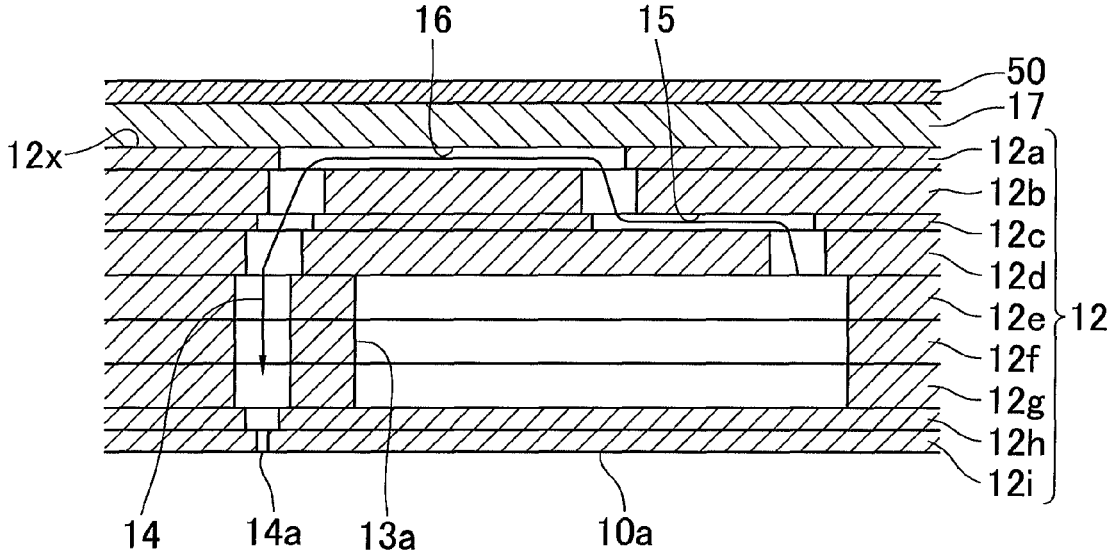
FIG. 4 is a partial sectional view taken along line IV-IV of FIG. 3.

The passage unit 12 is a stack constituted of nine quadrangular metal plates 12*a*, 12*b*, 12*c*, 12*d*, 12*e*, 12*f*, 12*g*, 12*h*, and 12*i* (see FIG. 4) of a substantially same size attached to one another. As shown in FIG. 2, openings 12*y* respectively facing openings 73*a* of the outflow passages 73 are formed at the upper surface 12*x*. Inside the passage unit 12, there are formed passages extending from the respective openings 12*y* to ejection openings 14*a*. As shown in FIGS. 2, 3, and 4, each of the passages includes: a manifold channel 13 having the opening 12*y* at its one end; sub-manifold channels 13*a* which are branches of the manifold channel 13; and individual passages 14 respectively extending from outlets of the sub-manifold channels 13*a* to the ejection openings 14*a* through the pressure chambers 16.

As shown in FIGS. 2 and 3, the manifold channel 13 and the sub-manifold channels 13*a* are in common among the plurality of ejection openings 14*a*. The individual passages 14 are formed for the respective ejection openings 14*a*, and each individual passage 14 includes: an aperture 15 acting as a throttle for adjusting passage resistance; and a pressure chamber 16 which opens onto the upper surface 12*x*, as shown in FIG. 4. As shown in FIG. 3, the pressure chambers 16, each of which has a substantially rhombus shape, are arranged in a matrix. A group of pressure chambers 16 occupies a substantially trapezoidal area in a plan view, and in total, eight pressure chamber groups 16G are formed. In the same way as the pressure chambers 16, the ejection openings 14*a* which open onto the ejection surface 10*a* are also arranged in a matrix, and constitute eight ejection opening groups 14G each of which groups occupies a substantially trapezoidal area in a plan view. The ejection opening groups 14G and the pressure chamber groups 16G are arranged on the ejection surface 10*a* and the upper surface 12*x* respectively, in a staggered fashion in two rows along the main scanning direction.

As shown in FIG. 2, each of the actuator units 17 has a trapezoidal planar shape and is disposed on a corresponding one of the trapezoidal areas of the pressure chamber groups 16G. A lower base of the trapezoidal shape of every actuator unit 17 is close to either of both ends, in the sub scanning direction, of the passage unit 12. The actuator units 17 are disposed in respective gaps created by the reservoir unit 11 and the passage unit 12, so as to avoid the protrusions provided at the under surface of the reservoir unit 11.

Although not shown in the drawings, each actuator unit 17 is a stack constituted of a diaphragm, a common electrode, a piezoelectric layer, and individual electrodes, which are stacked on one another in this order. Among the above-mentioned members, the piezoelectric layer, the diaphragm, and the common electrode have a trapezoidal shape of which size defines an outline of the actuator unit 17. The individual electrodes are disposed on an upper surface of the piezoelectric layer so as to face the corresponding pressure chambers 16 respectively, and have a substantially similar shape to that of the pressure chambers 16. The number of individual electrodes formed is the same as that of the pressure chambers 16 of a corresponding pressure chamber group 16G. The diaphragm is disposed between the common electrode and the passage unit 12. Each of the portions of the actuator unit 17 which respectively face the individual electrodes functions as a piezoelectric actuator independent from one another.

The FPC 50 is provided for each actuator unit 17, and has wires associated with the respective electrodes of the actuator unit 17. These wires are respectively connected to output terminals of the corresponding driver IC 57. Under the control of the controller 1*p* (see FIG. 1), the FPC 50 transmits various drive signals adjusted in the substrate 64 to the driver IC 57, and transmits drive signals generated by the driver IC 57 to the actuator unit 17.

Figure 6:
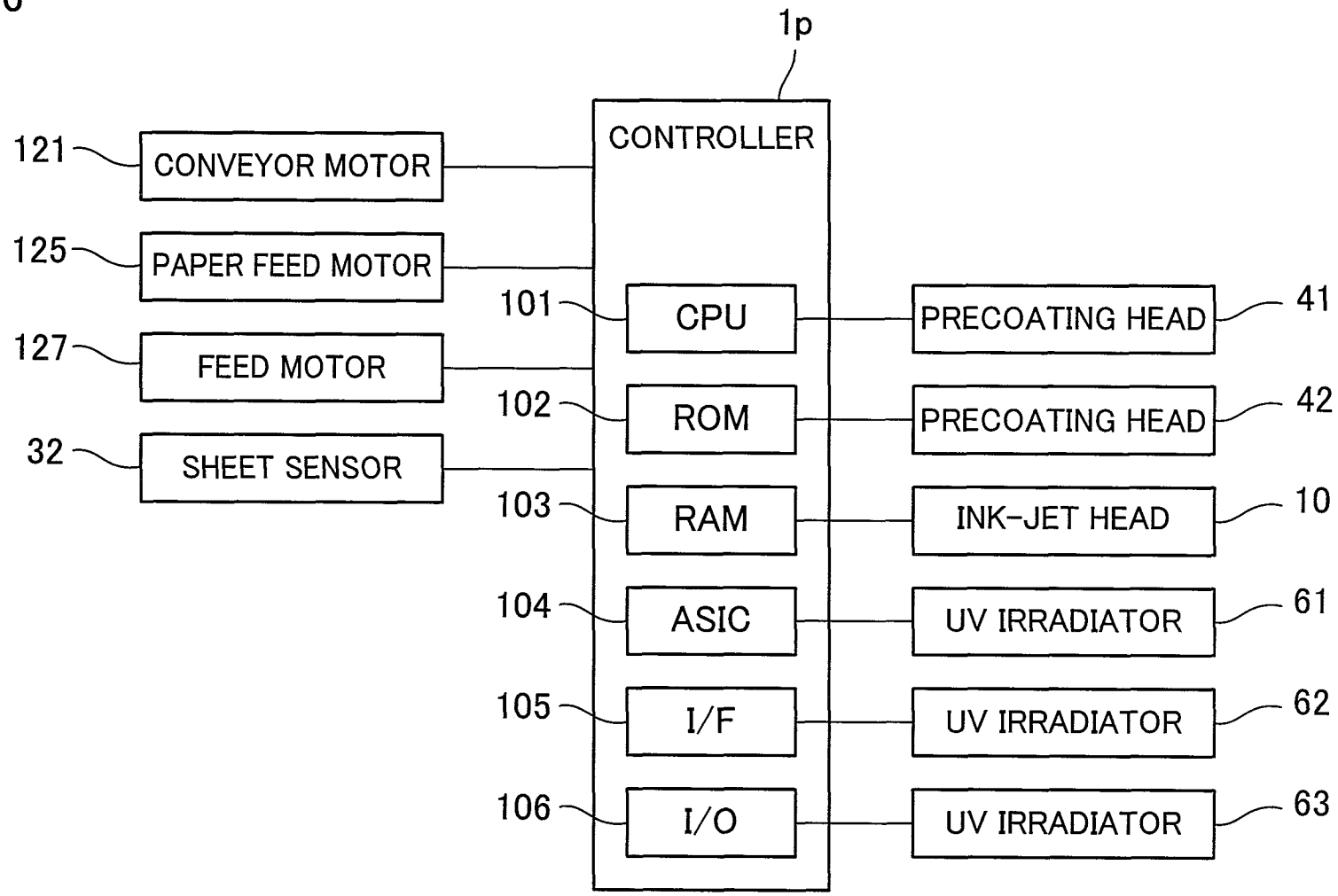
FIG. 6 is a block diagram illustrating an electrical structure of the printer of FIG. 1.

The following describes an electrical structure of the printer 1, with reference to FIG. 6.

As shown in FIG. 6, the controller 1*p* has, in addition to a CPU (Central Processing Unit) 101, a ROM (Read Only Memory) 102, a RAM (Random Access Memory, including a non volatile RAM) 103, an ASIC (Application Specific Integrated Circuit) 104, an I/F (Interface) 105, an I/O (Input/Output Port) 106, and the like. The ROM 102 stores therein: programs executed by the CPU 101; various fixed data such as data related to four types of drive signals for gradation control, which will be described later; and the like. The RAM 103 temporarily stores therein data needed at the time of execution of a program. In the ASIC 104, rewriting, sorting, or the like of image data such as signal processing or image processing is conducted. The I/F 105 transmits/receives data to/from the external device. The I/O 106 inputs/outputs detection signals of various sensors.

The controller 1*p* is connected to: the motors 121, 125, and 127; the sheet sensor 32, the control substrate of each of the heads 10, 41, and 42; the UV irradiators 61, 62, and 63; and the like. The controller 1*p* controls overall operation of printer 1, through various function units constructed by the programs. The function units include: for example, a motor driving unit which controls each of the motors 121, 125, and 127, a head driving unit which controls each of the heads 10, 41, and 42, a light source driving unit which controls the UV irradiators 61, 62, and 63; and the like.

Figure 7:
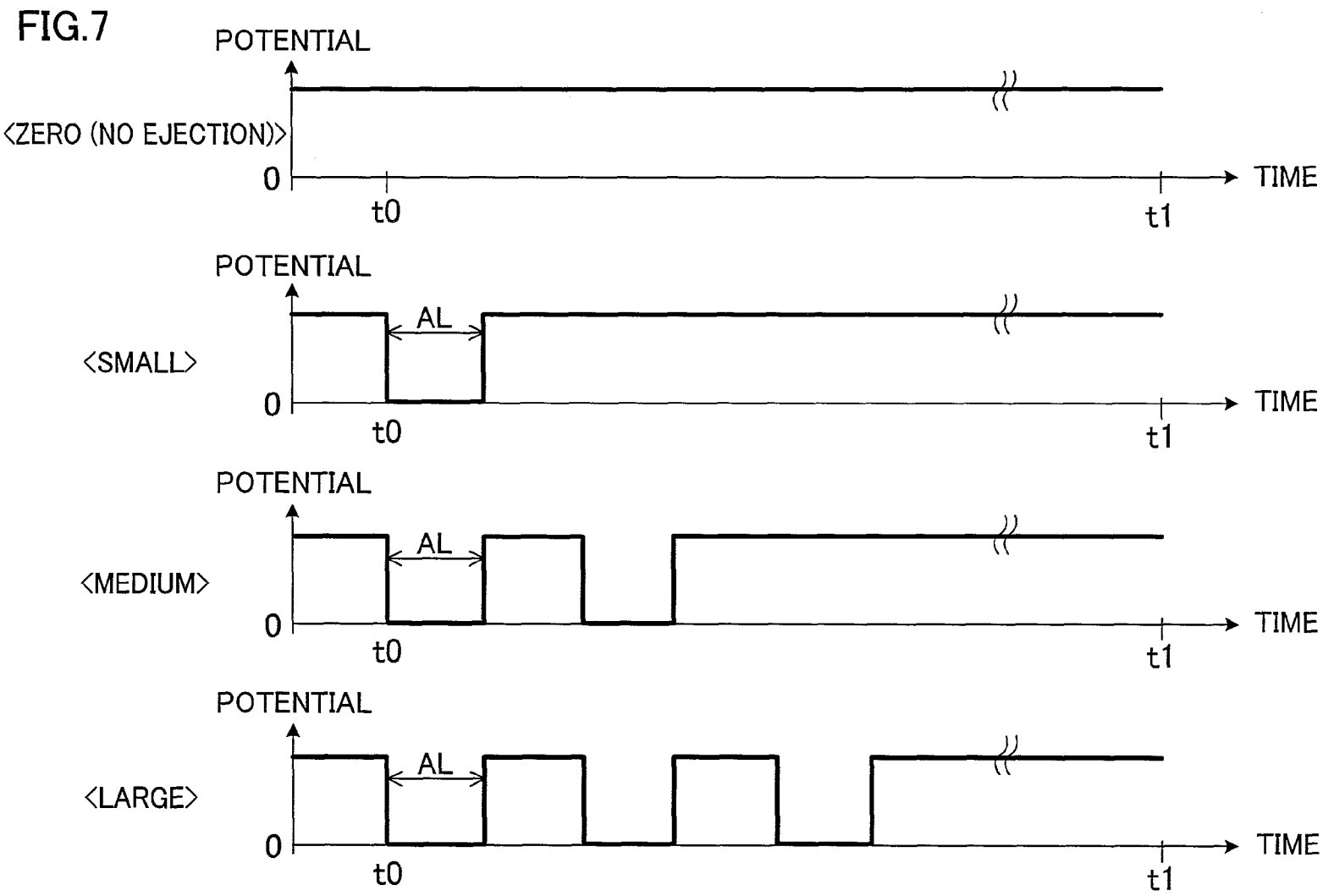
FIG. 7 is a graphical representation showing potential changes commanded by drive signals used for gradation control.

The following describes gradation control on each of the heads 10, 41, and 42, with reference to FIG. 7.

In this embodiment, the number of gradation levels is four (4), and four types of drive signals are stored in the ROM 102, which types respectively correspond to the following amounts of liquid forming one pixel: zero (no ejection); small; medium; and large. Each drive signal changes a potential of a concerned individual electrode relative to the corresponding common electrode, as shown with bold lines in FIG. 7. Note that the common electrode is always kept at a low level (in this embodiment, ground potential: 0 V).

In this embodiment, a so-called "fill-before-fire mode" is employed as a drive mode of the actuators, in which mode, the liquid is supplied (filled) into the pressure chambers 16 before the liquid is ejected (fired). To be more specific, before the controller 1*p* receives a recording command, all the individual electrodes are kept at a high level (for example, 15 V), while the common electrode is kept at the low level (for example, ground potential: 0 V), in each actuator unit 17. At this time, all the actuators of the actuator unit 17 are deformed, protruding toward the respective pressure chambers 16. On receiving a recording command, the controller 1*p* selects a drive signal based on image data, and starts to apply a voltage to a concerned individual electrode so that a potential difference corresponding to the drive signal is created between the individual electrode and the common electrode.

For example, in the case where the drive signal corresponds to the zero amount of liquid, the potential of the individual electrode remains at the high level. At this time, its actuator is in a protruding state, i.e., kept protruding toward the pressure chamber 16, and no liquid is ejected. In the case where the drive signal corresponds to the small amount of liquid, a change, from the high level to the low level and to the high level again, in the potential of the individual electrode is made once. When the potential of the individual electrode is changed to the same level as the potential of the common electrode, the actuator is caused to transition from the protruding state to a parallel state where the actuator is parallel to the ejection surface 10*a* (see FIG. 4), and this increases a capacity of the pressure chamber 16. Along with this, liquid supply from the corresponding sub-manifold channel 13*a* to the pressure chamber 16 is started. Then, when the supplied liquid reaches the pressure chamber 16, the potential of the individual electrode is returned from the low level to the high level again. At this time, the actuator is returned from the parallel state to the protruding state, and this decreases the capacity of the pressure chamber 16. Along with this, a pressure is applied to the liquid in the pressure chamber 16, and one droplet of the liquid is ejected.

A series of operations constituted of the liquid supply into the pressure chamber 16 and the liquid ejection from the corresponding ejection opening 14*a*, which have been described above, are carried out some number of times, the number corresponding to the number of pulses. Here, the pulse means a potential change which is quadrangular and in a form of a pulse, and is defined by: rising and falling edges of potential; and duration therebetween. In the case where the amount of liquid is small/medium/large, the number of pulses is one/two/three, the above-described series of operations are carried out once/twice/three times, and one/two/three droplet (s) of the liquid is (are) ejected. The ejected one to three droplet(s) of the liquid form(s) one pixel on a sheet P. The number of liquid droplets which have been ejected determines a size of the pixel (dot) formed on the sheet P.

Note that, the graphical representation of potential changes shown in FIG. 7 deals with one recording period. The recording period is a period of time required for a sheet P to move relatively to the head 10 for a unit distance corresponding to a resolution of an image to be recorded on a sheet P. On abscissas in FIG. 7, t0 represents a start time of the recording period, and t1 represents an end time of the recording period. The duration of a pulse is equal to an AL (Acoustic Length: a length of one-way propagation time of a pressure wave in each individual passage 14).

At the time of recording, the controller 1*p* conducts the above-described gradation control on each of the heads 10, 41, and 42. To be more specific, based on the image data included in the recording command, the controller 1*p* determines the number, i.e., total amount, of ink droplets ejected from the head 10, per pixel, that is, to form one dot. Further, the controller 1*p* determines whether or not to drive the heads 41 and 42, depending on the type of the sheet P, or the like. When the controller 1*p* drives the heads 41 and 42, the controller 1*p* determines, per pixel, the number of liquid droplets ejected from each of the heads 41 and 42, depending on a recording mode, which is a character mode for forming line images such as text, numerals, symbols, and the like, or a photo mode for forming images such as photographs, paintings, and the like. In the character mode, the controller 1*p* controls the conveyor unit 21 and the heads 41 and 42 so that: the number of liquid droplets ejected from the head 42 is the same as the number of liquid droplets ejected from the head 41; and a liquid droplet ejected from the head 42 overlaps, on a sheet P, a liquid droplet which has been ejected from the head 41. In the photo mode, the controller 1*p* controls the conveyor unit 21 and the heads 41 and 42 so that: the number of liquid droplets ejected from the head 42 is greater than the number of liquid droplets ejected from the head 41; and a liquid droplet ejected from the head 42 overlaps, on a sheet P, a liquid droplet which has been ejected from the head 41.

In the case where the controller 1*p* drives the heads 41 and 42 at the time of recording, the controller 1*p* controls the UV irradiators 62 and 63 so that an intensity of ultraviolet light applied by the UV irradiator 62 is greater than an intensity of ultraviolet light applied by the UV irradiator 63.

As described above, the printer 1 of this embodiment provides the pretreatment liquid on a sheet P through the two heads 41 and 42, in two separate operations. Here, in the photo mode, the controller 1*p* of the printer 1 determines, per pixel, the total amount of liquid droplets ejected from each of the heads 41 and 42 so that the total amount of liquid droplets ejected from the head 42 is greater than the total amount of liquid droplets ejected from the head 41.

Figure 8:
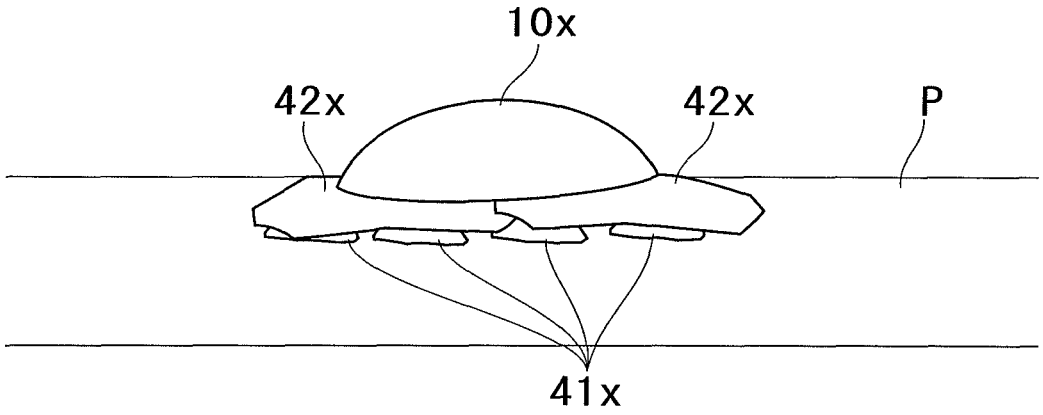
FIG. 8 is a schematic representation of a state of pretreatment liquid and ink which are ejected on a sheet in a photo mode.

In this case, as shown in FIG. 8, a smaller amount of pretreatment liquid is provided onto a sheet P by the head 41 to form smaller dots 41*x*, and then a larger amount of pretreatment liquid is provided by the head 42 to form larger dots 42*x*. Because of their smaller size, the dots 41*x* do not infiltrate into the sheet P to such an extent that bleed-through occurs, but are retained in a surface of the sheet P. As a result, the dots 41*x* form a layer in the surface of the sheet P. Since the layer constituted of the dots 41*x* already exists, it is hard for the dots 42*x* to infiltrate into the sheet P, and the dots 42*x* tend to spread in a direction of a plane of the sheet P. Thus, a layer constituted of the dots 42*x* is effectively formed on the layer constituted of the dots 41*x*.

This makes it possible to sufficiently obtain an advantageous effect of bleed prevention brought about by the pretreatment liquid. That is, an ink droplet 10*x* is prevented from bleeding on a sheet P, the ink droplet 10*x* landed on a portion of the sheet P where the dots 41*x* and 42*x* of the pretreatment liquid have been provided. In addition, it is not necessary to decrease the ejection amount of the pretreatment liquid for the purpose of preventing its bleed-through or the like, and this curbs the occurrence of a problem that the advantageous effect of bleed prevention is not sufficiently obtained due to an insufficient amount of pretreatment liquid.

The resolution of the head 41 (=1200 dpi) is higher than the resolution of the head 42 (=300 dpi). This further ensures that the above-described advantageous effects, such as an advantageous effect that the layers of the pretreatment liquid are formed in the surface of the sheet P, are obtained.

The resolution of the head 41 (=1200 dpi) is higher than the resolution of the head 10 (=600 dpi). This further ensures that the above-described advantageous effects, such as the advantageous effect that the layers of the pretreatment liquid are formed in the surface of the sheet P, are obtained.

The resolution of the head 42 (=300 dpi) is lower than the resolution of the head 10 (=600 dpi). The higher the resolution of the head 42, the higher the production cost goes. This embodiment makes it possible to obtain the above-described advantageous effects, such as the advantageous effect that the layers of the pretreatment liquid are formed in the surface of the sheet P, without increasing the resolution of the head 42. That is, it is possible to obtain the advantageous effect of bleed prevention brought about by the pretreatment liquid, while achieving a reduction in the production cost.

The UV irradiators 62 and 63 are provided at spaces interposed, in the conveyance direction, between the head 41 and the head 42 and between the head 42 and the head 10, respectively. In this arrangement, the dots 41*x* are cured by ultraviolet light applied by the UV irradiator 62 to some extent, and then the dots 42*x* are provided on the cured dots 41*x* so as to overlap the dots 41*x*. This further ensures that the above-described advantageous effects, such as the advantageous effect that the layers of the pretreatment liquid are formed in the surface of the sheet P, are obtained.

The controller 1*p* controls the UV irradiators 62 and 63 so that the intensity of ultraviolet light applied by the UV irradiator 62 is greater than the intensity of ultraviolet light applied by the UV irradiator 63. Thus, the dots 41*x* are rapidly cured by the ultraviolet light having the greater intensity applied by the UV irradiator 62. Therefore, the dots 41*x* do not infiltrate into a sheet P to such an extent that bleed-through occurs, but are retained in the surface of the sheet P. As a result, the dots 41*x* form a layer in the surface of the sheet P. Since the layer constituted of the dots 41*x* already exists, it is hard for the dots 42*x* of the pretreatment liquid subsequently ejected from the head 42 to infiltrate into the sheet P, and the dots 42*x* tend to spread in the direction of the plane of the sheet P. Thus, a layer constituted of the dots 42*x* is effectively formed on the layer constituted of the dots 41*x*. This makes it possible to sufficiently obtain the advantageous effect of bleed prevention brought about by the pretreatment liquid, as same as the above. In addition, it is not necessary to decrease the ejection amount of the pretreatment liquid for the purpose of preventing its bleed-through or the like, and this curbs the occurrence of a problem that the advantageous effect of bleed prevention is not sufficiently obtained due to an insufficient amount of pretreatment liquid.

In the character mode, the controller 1*p* controls the conveyor unit 21 and the heads 41 and 42 so that: per pixel, the total amount of liquid droplets ejected from the head 42 is the same as the total amount of liquid droplets ejected from the head 41; and a liquid droplet ejected from the head 42 overlap, on a sheet P, a liquid droplet which has been ejected from the head 41. In this case, dots formed by the pretreatment liquid ejected from the heads 41 and 42 have a same size. On the other hand, in the photo mode, the controller 1*p* controls the conveyor unit 21 and the heads 41 and 42 so that: per pixel, the total amount of liquid droplets ejected from the head 42 is greater than the total amount of liquid droplets ejected from the head 41; and a liquid droplet ejected from the head 42 overlap, on a sheet P, a liquid droplet which has been ejected from the head 41. In this case, each dot 42*x* formed by the pretreatment liquid ejected from the head 42 has a size larger than that of each dot 41*x* formed by the pretreatment liquid ejected from the head 41. Since the total amounts of the liquid droplets are thus changed depending on the recording mode, the pretreatment liquid is provided in a manner suitable for an image to be formed. This makes it possible to efficiently obtain the advantageous effect of bleed prevention brought about by the pretreatment liquid, in each mode. Particularly, in the photo mode, the smaller dots 41*x* formed by the smaller amount of pretreatment liquid ejected from head 41 and the larger dots 42*x* formed by the larger amount of pretreatment liquid ejected from the head 42 further ensure that the above-described advantageous effects, such as the advantageous effect that the layers of the pretreatment liquid are formed in the surface of the sheet P, are obtained. Therefore, it is possible to form a clear image of a photograph, painting, or the like, without causing bleed.

Note that the recording apparatus may include an arbitrary number of recording heads. In the case where the recording apparatus includes a plurality of recording heads, a UV irradiator does not have to be provided downstream of each of the recording heads in the conveyance direction, as long as the UV irradiator is provided downstream of at least one of the recording heads in the conveyance direction.

The recording apparatus may include three or more pretreatment heads.

In the present invention, the "recording liquid" means a liquid which directly contributes to image formation. The "pretreatment liquid" means a liquid which has, at least, a function of preventing bleed of the recording liquid on a recording medium.

The resolution of each head is not limited to the above-described resolution, but may be arbitrarily changed. In the above-described embodiment, the heads respectively having different resolutions are used, however, heads having a same resolution may be used, and in this case, a size or placement density (resolution) of dots may be adjusted by selecting ejection openings from which liquid droplets are ejected. For example, in the case where three heads each having a resolution of 1200 dpi are used, the following control is executed: an upstream pretreatment head is driven at the resolution of 1200 dpi as it is; ejection openings of a downstream pretreatment head are selectively driven so that dots are formed at a resolution of 300 dpi; and ejection openings of a recording head are selectively driven so that dots are formed at a resolution of 600 dpi. At this time, the number of liquid droplets ejected from each head varies depending on the size of the dots formed by the corresponding head.

According to the first aspect of the present invention, a difference in intensity of ultraviolet light does not have to be provided between the second UV irradiator and the third UV irradiator. The UV irradiator does not have to be provided downstream of each of the pretreatment heads in the conveyance direction, as long as it is provided downstream of the recording head in the conveyance direction. For example, in the above-described embodiment, the UV irradiator between the upstream pretreatment head and the downstream pretreatment head (the second UV irradiator: the UV irradiator 62 in the embodiment) may be omitted. In this case, from the view point that bleed of the pretreatment liquid ejected from the downstream pretreatment head should be curbed, a distance between the upstream pretreatment head and the downstream pretreatment head is longer than a distance between the downstream pretreatment head and the recording head. With this, the pretreatment liquid ejected from the upstream pretreatment head is dried to some extent before the pretreatment liquid ejected from the downstream pretreatment head overlaps it, and this curbs bleed-through of the pretreatment liquid ejected from the downstream pretreatment head. Furthermore, all the UV irradiators provided upstream of the recording head in the conveyance direction (the second UV irradiator and the third UV irradiator: the UV irradiators 62 and 63 in the embodiment) may be omitted.

According to the second aspect of the present invention, the total amount of liquid droplets ejected from each of the pretreatment heads does not have to be changed depending on the recording mode.

The present invention is applicable to both of a line-type apparatus and a serial-type apparatus. In addition, the present invention is applicable not only to a printer, but also to a facsimile machine, a copy machine, or the like. Furthermore, the recording apparatus may eject liquid other than ink.

The recording medium is not limited to a sheet P, but may be various medium on which recording is possible.

The conveyor does not have to be constituted of: the pair of rollers positioned apart from each other; and the endless conveyor belt looped around the rollers, but may be constituted of a platen and pairs of feed rollers, for example.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus, comprising:

a conveyor which conveys a recording medium in a conveyance direction;

a recording head which ejects, to the recording medium, recording liquid curable by irradiation of ultraviolet light;

a plurality of pretreatment heads each of which is positioned upstream of the recording head in the conveyance direction, and ejects, to the recording medium, pretreatment liquid curable by irradiation of ultraviolet light, the pretreatment heads including a downstream pretreatment head and an upstream pretreatment head which is positioned upstream of the downstream pretreatment head in the conveyance direction;

a first UV irradiator which is positioned downstream of the recording head in the conveyance direction and applies ultraviolet light to the recording medium; and a controller which controls the conveyor, the recording head, the pretreatment heads, and the first UV irradiator, wherein the controller controls the conveyor and the pretreatment heads to cause: a total amount of liquid droplets ejected from the downstream pretreatment head to be greater than a total amount of liquid droplets ejected from the upstream pretreatment head; and a liquid droplet ejected from the downstream pretreatment head to overlap, on the recording medium, a liquid droplet which has been ejected from the upstream pretreatment head, and wherein a resolution of the upstream pretreatment head is higher than a resolution of the downstream pretreatment head.

2. The recording apparatus according to claim 1, wherein a resolution of the upstream pretreatment head is higher than a resolution of the recording head.

3. The recording apparatus according to claim 2, wherein a resolution of the downstream pretreatment head is lower than the resolution of the recording head.

4. The recording apparatus according to claim 1, further comprising:

a second UV irradiator which is positioned between the upstream pretreatment head and the downstream pretreatment head in the conveyance direction, and applies ultraviolet light to the recording medium; and a third UV irradiator which is positioned between the downstream pretreatment head and the recording head in the conveyance direction, and applies ultraviolet light to the recording medium.

5. The recording apparatus according to claim 4, wherein the controller controls the second UV irradiator and the third UV irradiator to cause an intensity of ultraviolet light applied by the second UV irradiator to be greater than an intensity of ultraviolet light applied by the third UV irradiator.

6. A recording apparatus, comprising:

a conveyor which conveys a recording medium in a conveyance direction;

a recording head which ejects, to the recording medium, recording liquid curable by irradiation of ultraviolet light;

a plurality of pretreatment heads each of which is positioned upstream of the recording head in the conveyance direction, and ejects, to the recording medium, pretreatment liquid curable by irradiation of ultraviolet light, the pretreatment heads including a downstream pretreatment head and an upstream pretreatment head which is positioned upstream of the downstream pretreatment head in the conveyance direction;

a first UV irradiator which is positioned downstream of the recording head in the conveyance direction and applies ultraviolet light to the recording medium;

a second UV irradiator which is positioned between the upstream pretreatment head and the downstream pretreatment head in the conveyance direction, and applies ultraviolet light to the recording medium;

a third UV irradiator which is positioned between the downstream pretreatment head and the recording head in the conveyance direction, and applies ultraviolet light to the recording medium; and a controller which controls the conveyor, the recording head, the pretreatment heads, the first UV irradiator, the second UV irradiator, and the third UV irradiator, wherein the controller controls the second UV irradiator and the third UV irradiator to cause an intensity of ultraviolet light applied by the second UV irradiator to be greater than an intensity of ultraviolet light applied by the third UV irradiator, wherein, in a character mode, the controller controls the conveyor and the pretreatment heads to cause:

a total amount of liquid droplets ejected from the downstream pretreatment head to be same as a total amount of liquid droplets ejected from the upstream pretreatment head; and a liquid droplet ejected from the downstream pretreatment head to overlap, on the recording medium, a liquid droplet which has been ejected from the upstream pretreatment head, and wherein, in a photo mode, the controller controls the conveyor and the pretreatment heads to cause:

a total amount of liquid droplets ejected from the downstream pretreatment head to be greater than a total amount of liquid droplets ejected from the upstream pretreatment head; and a liquid droplet ejected from the downstream pretreatment head to overlap, on the recording medium, a liquid droplet which has been ejected from the upstream pretreatment head.

7. The recording apparatus according to claim 6, wherein a resolution of the upstream pretreatment head is higher than a resolution of the downstream pretreatment head.

8. The recording apparatus according to claim 6, wherein a resolution of the upstream pretreatment head is higher than a resolution of the recording head.

9. The recording apparatus according to claim 8, wherein a resolution of the downstream pretreatment head is lower than the resolution of the recording head.

* * * * *